US011456137B2

(12) United States Patent
Yoon et al.

(10) Patent No.: US 11,456,137 B2
(45) Date of Patent: Sep. 27, 2022

(54) ELECTROSTATIC DRIVE SWITCH

(71) Applicant: Korea Advanced Institute of Science And Technology, Daejeon (KR)

(72) Inventors: Jun-Bo Yoon, Daejeon (KR); Su-Bon Kim, Daejeon (KR); Yong-Bok Lee, Daejeon (KR)

(73) Assignee: Korea Advanced Institute of Science and Technology

( * ) Notice: Subject to any disclaimer, the term of this patent is extended or adjusted under 35 U.S.C. 154(b) by 63 days.

(21) Appl. No.: 16/934,793

(22) Filed: Jul. 21, 2020

(65) Prior Publication Data

US 2021/0202199 A1 Jul. 1, 2021

(30) Foreign Application Priority Data

Dec. 30, 2019 (KR) ..... 10-2019-0178005
Apr. 27, 2020 (KR) ..... 10-2020-0050895

(51) Int. Cl.
*H01H 59/00* (2006.01)

(52) U.S. Cl.
CPC . *H01H 59/0009* (2013.01); *H01H 2059/0063* (2013.01); *H01H 2201/024* (2013.01)

(58) Field of Classification Search
CPC ..... H01H 59/0009; H01H 2059/0063; H01H 2201/024; H01H 59/00; H02N 1/06; H02N 1/006; H02N 1/00
USPC ..... 200/181; 310/309
See application file for complete search history.

(56) References Cited

U.S. PATENT DOCUMENTS 9,318,291 B2 4/2016 Yoon et al.
2010/0163376 A1* 7/2010 Yoon ..... H02N 1/006 200/181
2014/0158506 A1* 6/2014 Yoon ..... H01H 59/0009 200/181

FOREIGN PATENT DOCUMENTS

KR 10-1380604 B1 4/2014
KR 10-20160088109 A 7/2016

OTHER PUBLICATIONS

Korean Office Action dated Aug. 31, 2021 as issued in related Korean Application No. 9-5-2021-069067793 (3 pages).

* cited by examiner

*Primary Examiner* — Edwin A. Leon
*Assistant Examiner* — Iman Malakooti
(74) *Attorney, Agent, or Firm* — Foley & Lardner LLP

(57) ABSTRACT

Provided is an electrostatic drive switch, which includes a source plate to which a voltage for driving the electrostatic drive switch is applied and a drain electrode spaced apart from the source plate. The source plate includes a source electrode and an elastic part connected to the source electrode, and a first material and a second material having lower hardness than the first material are provided on the source electrode. When the source electrode and the drain electrode are electrically connected to each other by the voltage, the second material is brought into contact with the drain electrode by the elastic part after the first material is brought into contact with the drain electrode by the elastic part.

12 Claims, 10 Drawing Sheets

ELECTROSTATIC DRIVE SWITCH

CROSS-REFERENCE TO RELATED APPLICATION

This application claims priority to Korean Patent Application No. 10-2019-0178005 filed on Dec. 30, 2019 and Korean Patent Application No. 10-2020-0050895 filed on Apr. 27, 2020 and all the benefits accruing therefrom under 35 U.S.C. § 119, the contents of which are incorporated by reference in their entirety.

BACKGROUND

The present disclosure relates to an electrostatic drive switch to improve reliability of a MEMS switch even in a high-voltage and high-current switching condition and also maximize a contact force by reducing contact resistance at a contact point.

To this end, the present disclosure relates to an electrostatic drive switch utilizing a dual contact method, in which a high-current signal and a high-voltage signal may be switched, by establishing first contact with a material having high hardness to ensure reliability and then establishing second contact with a material having relatively low hardness to maximize the contact force and reduce the contact resistance.

MEMS switches with excellent switching performance and low power consumption have been diversely utilized in various application fields such as wireless frequency and semiconductor tests.

Such a MEMS switch is required to have high reliability in high-voltage and/or high-current, but generally it is difficult to obtain high reliability in a high-voltage and/or high-current condition. Thus, MEMS switches in the related art are operated at an extremely low power level.

In general, the reliability becomes low because switching performance of the MEMS switch is significantly deteriorated as failure mechanism occurs in a contact area of a high power level. For example, as an example illustrated in FIG. 1, high contact resistance is induced when a source comes into contact with a drain, resulting in the occurrence of thermal damage (welding) at a contact point due to generation of joule's heat caused by a high-current signal or resulting in the occurrence of arc at a contact point due to a high electric field.

That is, there are needs to improve the reliability by eliminating reliability deteriorating factors, such as the occurrence of welding, arc, or the like, and maximize the contact force by reducing the contact resistance at the contact point, even in the high-voltage and/or high-current switching condition.

SUMMARY

The present disclosure is to improve reliability by eliminating reliability deteriorating factors, such as the occurrence of welding, arc, or the like, and reduce contact resistance at a contact point by maximizing a contact force, even in a high-voltage and/or high-current switching condition.

Particularly, the present disclosure is to enable switching of a high-current signal and a high-voltage signal by utilizing a dual contact method. Firstly, contact with a material having high hardness is made to ensure reliability with respect to high-voltage. Subsequently, to solve a contact resistance limitation due to the material having high hardness, contact with a material having relatively low hardness is made to maximize a contact force and reduce contact resistance.

Also, the present disclosure is to enable switching of a high-current signal and a high-voltage signal by using an elastic part of a source plate in a plate-shaped electrostatic drive switch.

In accordance with an exemplary embodiment of the present disclosure, an electrostatic drive switch includes: a source plate to which a voltage for driving the electrostatic drive switch is applied; and a drain electrode spaced apart from the source plate, wherein the source plate includes a source electrode and an elastic part connected to the source electrode, and a first material and a second material having lower hardness than the first material are provided on the source electrode. When the source electrode and the drain electrode are electrically connected to each other by the voltage, the second material is brought into contact with the drain electrode by the elastic part after the first material is brought into contact with the drain electrode by the elastic part.

The source electrode may include a first source electrode portion on which the first material is provided and a second source electrode portion on which the second material is provided, and the elastic part may include a first elastic portion disposed in an outer portion of the source plate and a second elastic portion connected to the first source electrode portion, wherein the second material provided on the second source electrode portion is brought into contact with the drain electrode by the second elastic portion after the first material provided on the first source electrode portion is brought into contact with the drain electrode by the first elastic portion.

The drain electrode may include a first drain electrode portion made of a third material and a second drain electrode portion made of a fourth material, wherein the second material provided on the second source electrode portion is brought into contact with the second drain electrode portion by the second elastic portion after the first material provided on the first source electrode portion is brought into contact with the first drain electrode portion by the first elastic portion.

The third material may be the same material as the first material, and the fourth material may be the same material as the second material.

The electrostatic drive switch may further include an dielectric layer, wherein the source electrode further includes a third source electrode portion in which neither the first material nor the second material is provided, and the third source electrode portion is brought into contact with the dielectric layer by a third elastic portion connected to the second source electrode portion.

The third elastic portion may include a beam that has a spring constant greater than that of the second elastic portion.

At least one of an area of the first source electrode portion and an area of the second source electrode portion may be less than an area of the third source electrode portion.

An area of the first material provided on the first source electrode portion may be less than an area of the first drain electrode portion made of the third material, and an area of the second material provided on the second source electrode portion may be less than an area of the second drain electrode portion made of the fourth material.

A height of the first source electrode portion may be greater than a height of the second source electrode portion.

Each of the first source electrode portion, the second source electrode portion, the first elastic portion, and the second elastic portion may be provided in plurality.

Both a center of the plurality of first source electrode portions and a center of the plurality of second source electrode portions may be the same as a center of the source plate.

When the source electrode and the drain electrode are separated from each other, the first material may be separated from the drain electrode by the elastic part after the second material is separated from the drain electrode by the elastic part.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Figure 1:
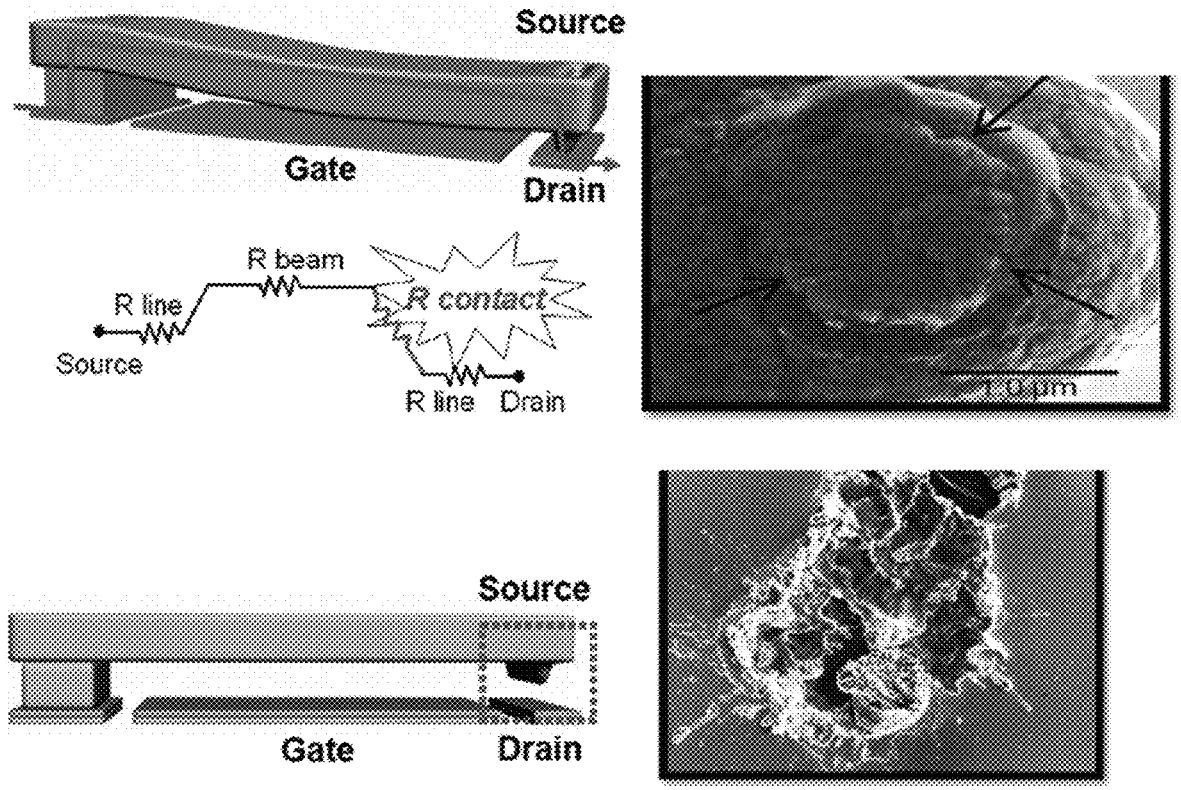
FIG. 1 shows an electrostatic drive switch according to the related art.

In the following detailed description of the present disclosure, reference is made to the accompanying drawings that illustrate specific embodiments in which the present disclosure may be practiced. These embodiments will be described in detail for those skilled in the art in order to practice the present disclosure. It should be appreciated that various embodiments of the present disclosure are different but do not have to be exclusive. For example, specific shapes, configurations, and characteristics described in an embodiment of the present disclosure may be implemented in another embodiment without departing from the spirit and the scope of the present disclosure. In addition, it should be understood that positions or arrangements of individual components in each disclosed embodiment may be changed without departing from the spirit and the scope of the present disclosure. Therefore, a detailed description described below should not be construed as being restrictive, and the scope of the present disclosure is defined only by the accompanying claims and their equivalents if appropriate. Similar reference numerals will be used to describe the same or similar functions throughout the accompanying drawings.

Figure 2A:
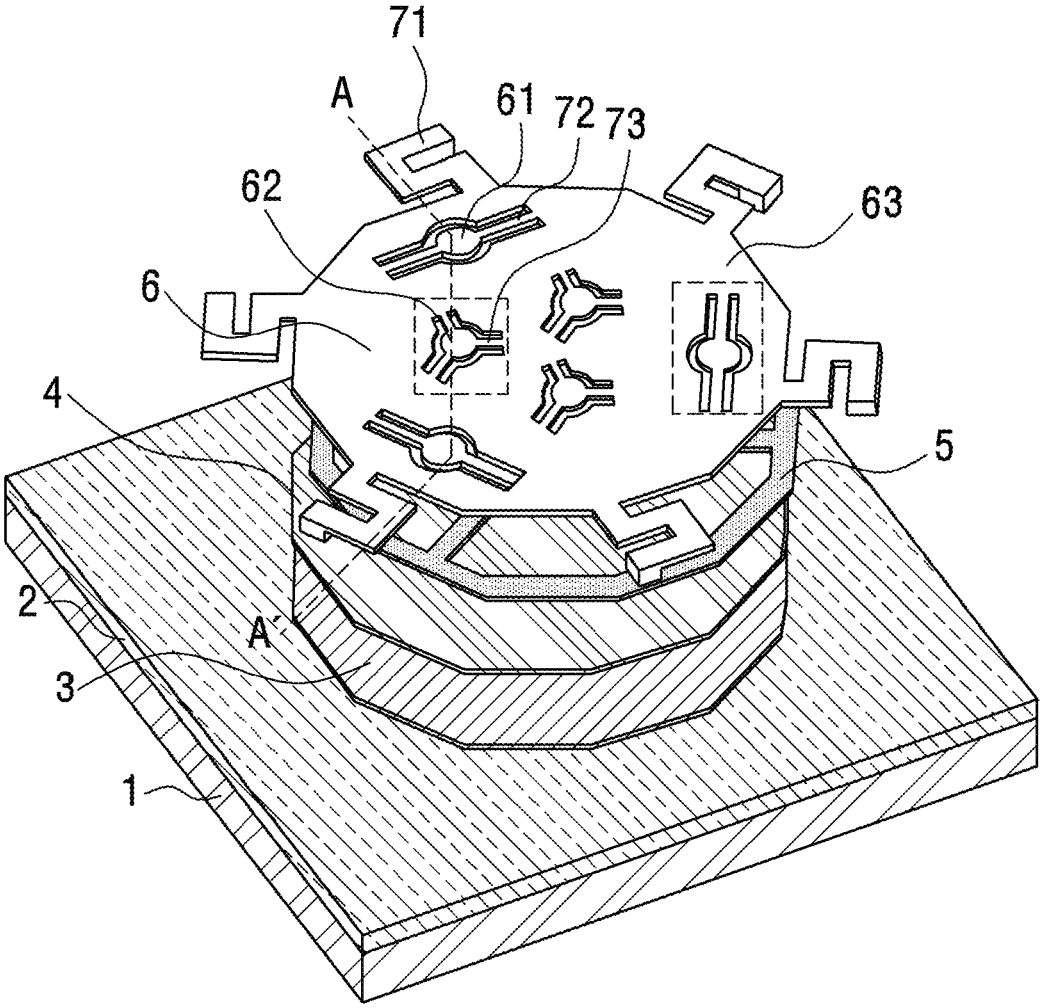
FIG. 2A is a perspective view of an electrostatic drive switch according to an embodiment.
Figure 3:
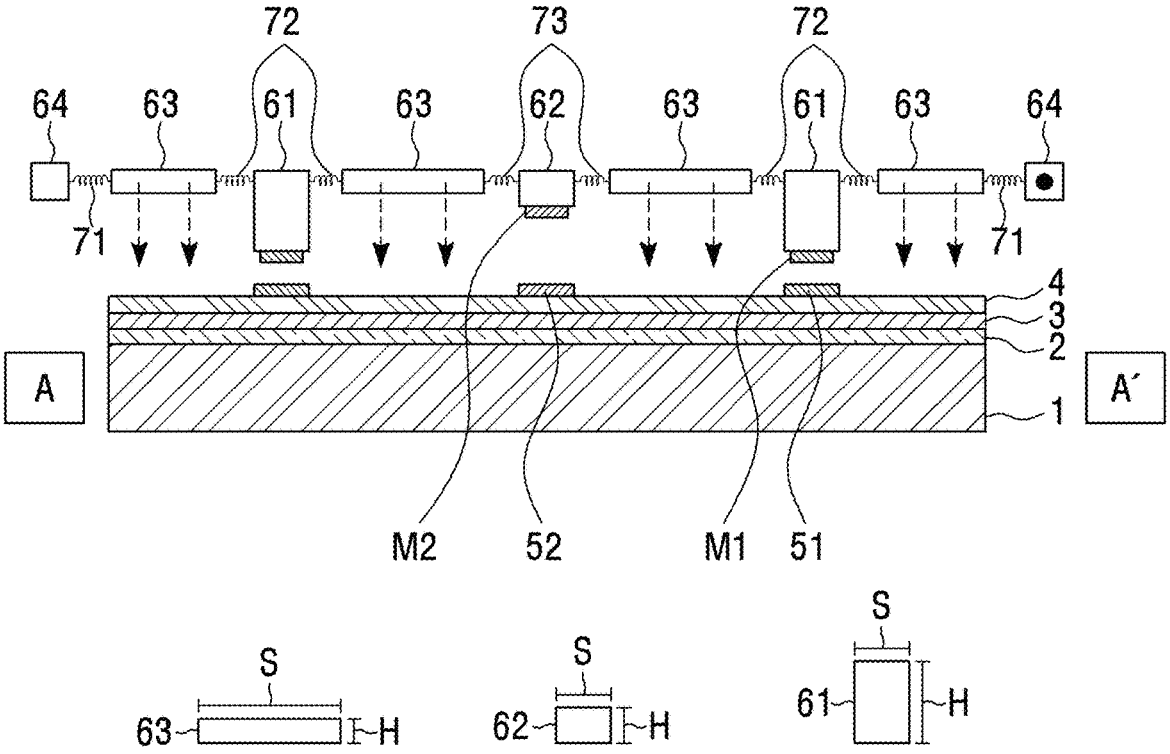
FIG. 3 is a side cross-sectional view of the electrostatic drive switch of FIG. 2A, taken along line A-A.

FIG. 2A is a perspective view of an electrostatic drive switch according to an embodiment, and FIG. 3 is a side cross-sectional view of the electrostatic drive switch of FIG. 2A, taken along line A-A'.

Referring to FIGS. 2A and 3 together, an electrostatic drive switch according to an embodiment may include, in the following order from the bottom, a substrate 1, an insulating layer 2 disposed on the substrate 1, a gate electrode 3 disposed on the insulating layer 2, a dielectric layer 4 disposed on the gate electrode 3, a drain electrode 5 disposed on the dielectric layer 4, and a source plate 6 disposed spaced a predetermined distance from the drain electrode 5.

A voltage for controlling operation of the electrostatic drive switch may be applied to the gate electrode 3, and a power source voltage or a ground voltage may be applied to the source plate 6 by the gate electrode 3. The drain electrode 5 may come into contact with the source plate 6 as the source plate 6 is moved downward by an electrostatic force that is generated between the gate electrode 3 and the source plate 6.

The source plate 6 may be embodied in a plate-type structure having a predetermined thickness, and in the present disclosure, the plate-type source plate 6 and an elastic part 70 may be used to perform sequential switching of dual contact materials and maximize a contact force. FIG. 2A illustrates a plate-type structure in which the top surface is a dodecagon, but the scope of the present disclosure is not limited thereto. A hexagon, a decagon, an octadecagon, and the like may be applied to the present disclosure in the same/similar manner.

The source plate 6 may include a source electrode 60 and the elastic part 70. The source electrode 60 may include a first source electrode portion 61, a second source electrode portion 62, a third source electrode portion 63, and an anchor electrode 64. The elastic part 70 may include a first elastic portion 71, a second elastic portion 72, and a third elastic portion 73.

In one source plate 6, the anchor electrode 64 is disposed in an outer portion thereof, three first source electrode portions 61 are disposed further inward than the anchor electrode 64, and three second source electrode portions 62 are disposed further inward than the three first source electrode portions 61. The third source electrode portion 63 may be disposed each of between the anchor electrode 64 and the first source electrode portion 61 and between the first source electrode portion 61 and the second source electrode portion 62. However, the number of each source electrode portion is merely an embodiment, and the scope of the present disclosure is not limited thereto.

The three first source electrode portions 61 may have an equilateral triangle configuration so that distances from a center of the source plate 6 to the three first source electrode portions 61 are equal to each other, and The three second source electrode portions 62 may also have an equilateral triangle configuration so that distances from the center of the source plate 6 to the three second source electrode portions 62 are equal to each other. Also, when the configuration formed by the three first source electrode portions 61 is an equilateral triangle having a forward orientation, the configuration formed by the three second source electrode portions 62 is an equilateral triangle having a reverse orientation. That is, each of a center of the three first source electrode portions 61 and a center of the three second source electrode portions 62 is configured to be the same as the center of the source plate 6, and thus, the overall uniform electrostatic force may be maintained in the source plate 6.

The source plate 6 may be disposed facing the drain electrode 5 while being spaced a predetermined distance therefrom.

A first material M1 may be provided on the bottom surface of the first source electrode portion 61.

The top surface of the first source electrode portion 61 may be configured to be circular.

The first source electrode portion 61 may be disposed facing a first drain electrode portion 51.

The first source electrode portion 61 may be configured such that a height H of the first source electrode portion 61 is greater than a height H of the second source electrode portion 62. This is intended that the first material M1 provided on the first source electrode portion 61 is brought into contact with the drain electrode 5 earlier than does a second material M2 provided on the second source electrode portion 62. Thus, a gap between the first material M1 and the first drain electrode portion 51 may be less than a gap between the second material M2 and the second drain electrode portion 52.

Figure 2B:
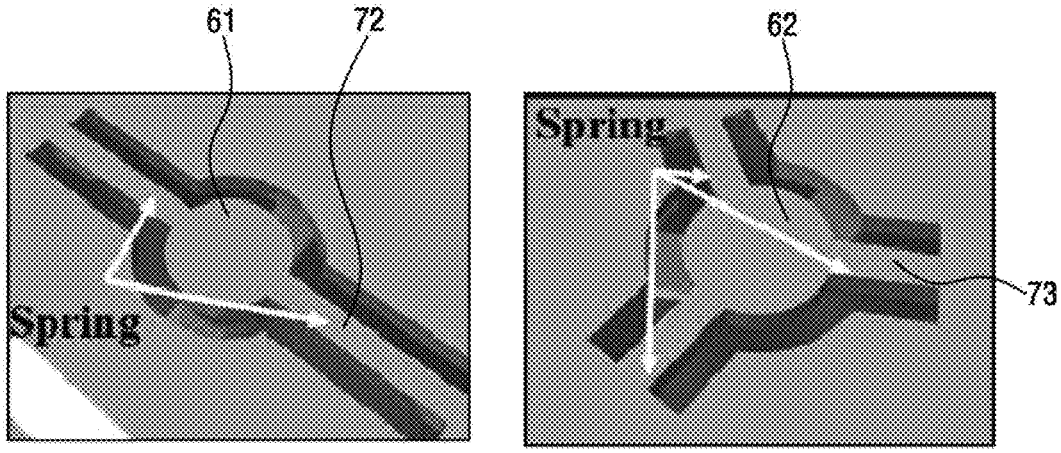
FIGS. 2B and 2C are enlarged views of an elastic part that constitutes the electrostatic drive switch of FIG. 2A.

Referring to FIG. 2B, second elastic portions 72 are configured by two beams, and the first source electrode portion 61 is positioned at the center of the two beams. The beams may extend from the first source electrode portion 61 in the opposite directions, and the angle therebetween may be about 180 degrees. The lengths of the two beams may be equal to each other. For reference, the two beams constituting the second elastic portions 72 may have a relatively lower spring constant than that of three beams constituting third elastic portions 73 described later.

The second material M2 may be provided on the bottom surface of the second source electrode portion 62.

The top surface of the second source electrode portion 62 may be configured to be circular.

The second source electrode portion 62 may be disposed facing a second drain electrode portion 52.

The height H1 of the second source electrode portion 62 may be configured to be less than the height H of the first source electrode portion 61. This is intended that the second material M2 provided on the second source electrode portion 62 is brought into contact with the drain electrode 5 later than does the first material M1 provided on the first source electrode portion 61. Thus, the gap between the second material M2 and the second drain electrode portion 52 may be greater than the gap between the first material M1 and the first drain electrode portion 51.

Referring to FIG. 2B, the third elastic portions 73 are configured by three beams, and the second source electrode portion 62 is positioned at the center of the three beams. The angle between the three beams may be about 120 degrees, and the three beams may extend the same length from the second source electrode portion 62. For reference, the three beams constituting the third elastic portions 73 may have a relatively higher spring constant than that of the two beams constituting the second elastic portions 72 described above.

A material may not be provided on the bottom surface of the third source electrode portion 63.

The area S of the first source electrode portion 61 and/or the area S of the second source electrode portion 62 may be configured to be smaller than the area of the third source electrode portion 63.

The elastic part 70 may have a spring structure and include a material having a restoring force.

The first elastic portion 71 may connect the anchor electrode 64 to the third source electrode portion 63, the second elastic portion 72 may connect the third source electrode portion 63 to the first source electrode portion 61, and the third elastic portion 73 may connect the third source electrode portion 63 to the second source electrode portion 62.

The first elastic portion 71 may be disposed, in an outer portion of the source plate 6, as a serpentine structure having an anchor shape.

The source plate 6 may include six first elastic portions 71, and the six first elastic portions 71 may be equidistantly spaced apart from each other. Also, as a result, the source plate 6 may be stably supported. Three of the six first elastic portions 71 may be used when the first material M1 is brought into contact with the drain electrode 5, and the other three may be used when the second material M2 is brought into contact with the drain electrode 5.

Figure 2C:
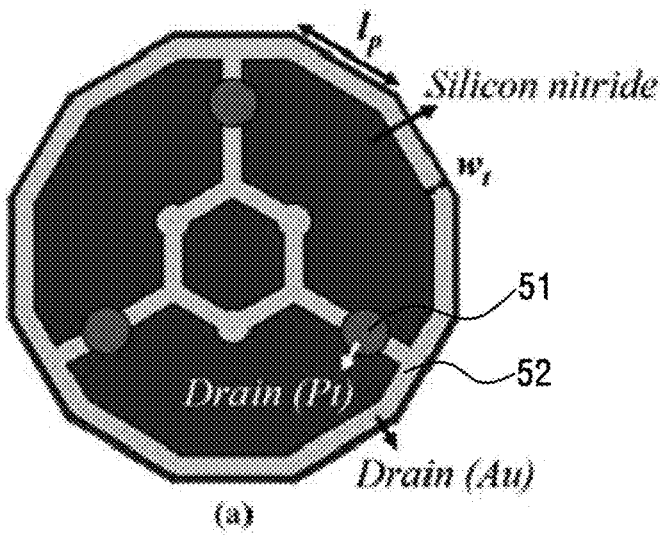

In order for the electrostatic force to be transmitted from the gate electrode 3 to the source electrode 60, the drain electrode 5 may be provided, on the dielectric layer 4, as a mesh pattern structure as illustrated in FIG. 2C.

The drain electrode 5 may include the first drain electrode portion 51 made of a third material M3 and the second drain electrode portion 52 made of a fourth material M4.

The first drain electrode portion 51 and the second drain electrode portion 52 may be provided on the top surface of the dielectric layer 4.

Referring to FIG. 2C again, the drain electrode 5 may have a shape in which the first drain electrode portion 51 and the second drain electrode portion 52 are connected to each other, and are brought into contact with the first material M1 and the second material M2, respectively, when the electrostatic force is applied to the source plate 6.

In the present disclosure, the area of the first material M1 provided on the first source electrode portion 61 may be configured to be less than the area of the first drain electrode portion 51 made of the third material M3, and the area of the second material M2 provided on the second source electrode portion 62 may be configured to be less than the area of the second drain electrode portion 52 made of the fourth material M4.

In the present disclosure, the first material M1 to the fourth material M4 may include a CNT, a refractory metal, an alloy, an oxidized metal, diamond, platinum (Pt), gold (Au), silver (Ag), or the like.

In the present disclosure, the first material M1 may be configured to be the same as the third material M3, and the second material M2 may be configured to be the same as the fourth material M4. However, the scope of the present disclosure is not limited thereto.

The insulating layer 2 may be disposed on a silicon substrate 1, and the dielectric layer 4 may be disposed between the gate electrode 3 and the drain electrode 5.

Each of the insulating layer 2 and the dielectric layer 4 may have a role in providing electrical insulation and serve as a heat sink.

Figure 4A:
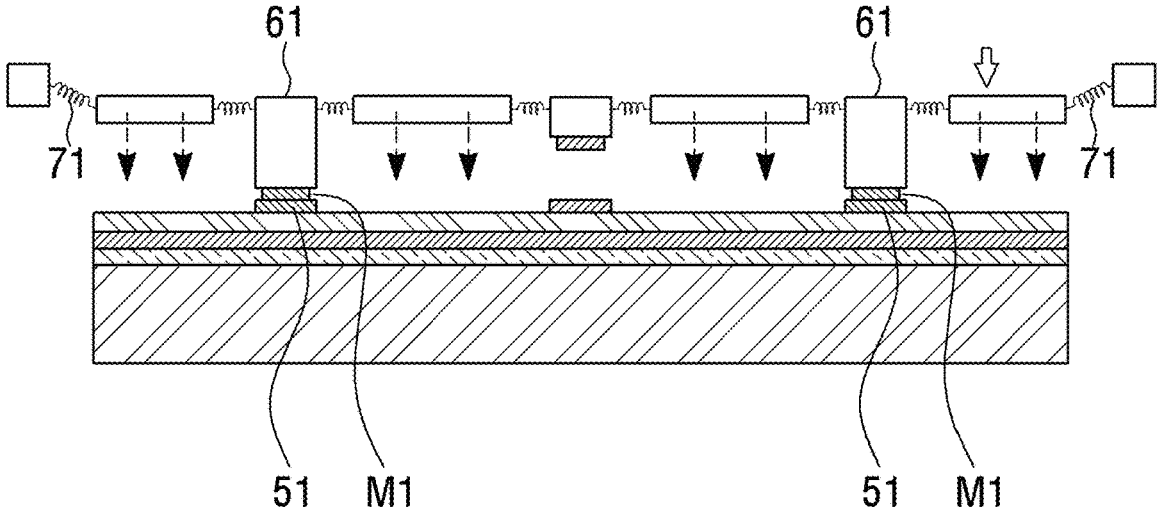
FIGS. 4A to 4C show an operation method for an electrostatic drive switch according to an embodiment.
Figure 4B:
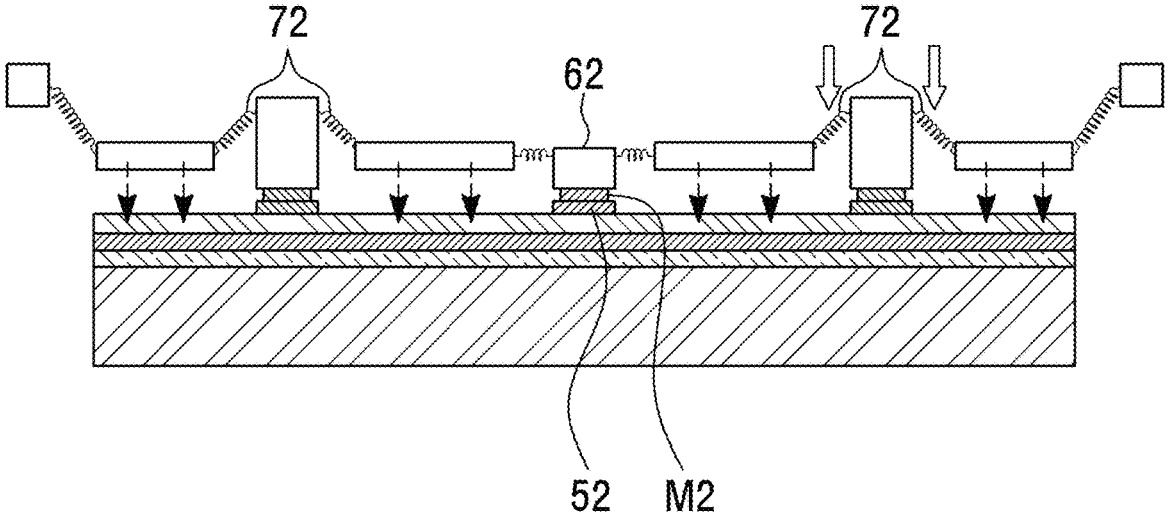
Figure 4C:
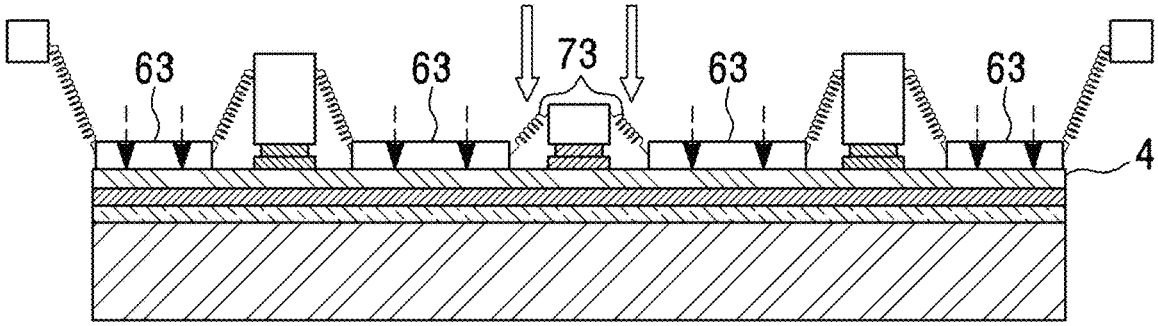
Figure 5:
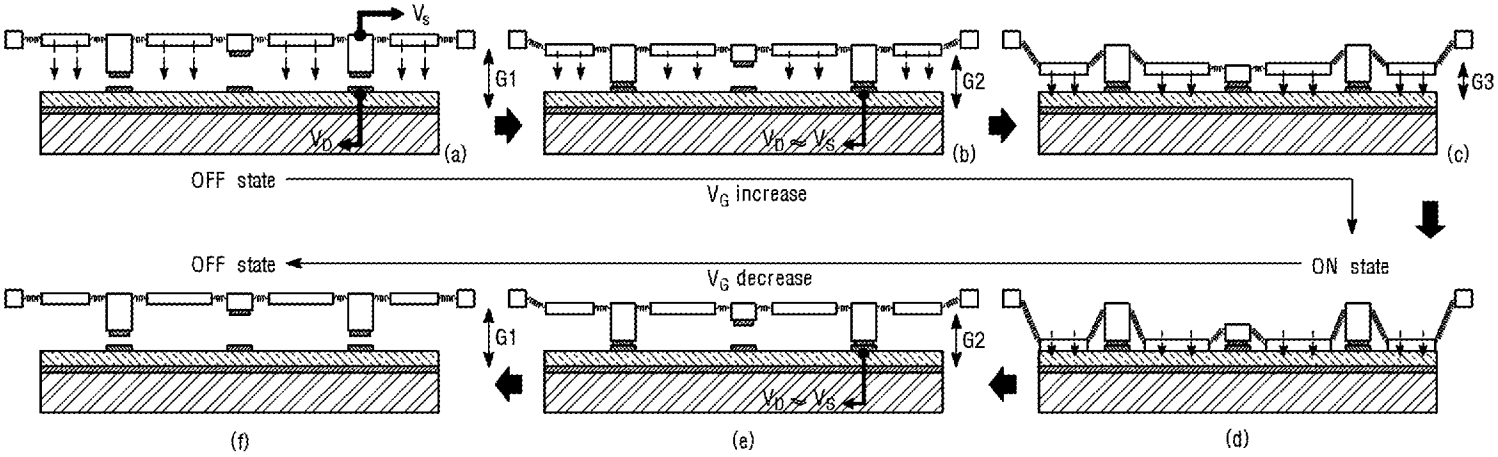
FIG. 5 shows a state in which a voltage is applied to operate an electrostatic drive switch.

FIGS. 4A to 4C show an operation method for an electrostatic drive switch according to an embodiment, and FIG. 5 shows a state in which a voltage is applied to operate an electrostatic drive switch.

Firstly, FIG. 3 and (a) of FIG. 5 show an initial state in which a voltage is not applied to the electrostatic drive switch. Subsequently, when a voltage is applied to the gate electrode 3 and if the voltage is equal to a first pull-in voltage of the first source electrode portion 61 and less than a second pull-in voltage of the second source electrode portion 62, the first elastic portion 71 is deformed as illustrated in FIG. 4A and (b) of FIG. 5, and the first source electrode portion 61 may come into contact with the first drain electrode portion 51. In particular, the first elastic portion 71 is deformed into a bent shape having an inclination downward from the horizontal direction, and thus, the first material M1 provided on the bottom surface of the first source electrode portion 61 may come into contact with the first drain electrode portion 51 made of the third material M3. Here, the first material M1 and the third material M3 are the same material and may include, for example, platinum (Pt) having hardness higher than that of each of the second material M2 and the fourth material M4. However, the scope of the present disclosure is not limited thereto. Also, according to another embodiment, a first material M1 and a third material M3, which have higher hardness than a second material M2 and a fourth material M4 but are made of different materials having different hardness, may be applied to the present disclosure in the same/similar manner.

In the present disclosure, the gap between the first material M1 and the third material M3 is less than the gap between the second material M2 and the fourth material M4, and thus, the contact between the first material M1 and the third material M3 is made earlier than is the contact between the second material M2 and the fourth material M4. In particular, in a case where platinum-platinum contact is made, when considering the characteristics of a platinum material having relatively high hardness, an arc phenomenon due to a high voltage generated between the source electrode 60 and the drain electrode 3 is overcome, and thus, reliability may be improved.

In the present disclosure, the first elastic portion 71, the first source electrode portion 61, and the first drain electrode portion 51 may be provided in plurality. When the plurality of first elastic portions 71 are deformed together in an edge of one side of the source plate 6 and in an edge of the other side thereof, a plurality of first materials M1 provided on the bottom surfaces of the plurality of first source electrode portions 61 may simultaneously come into contact with the plurality of first drain electrode portions 51 which are made of a plurality of third materials M3 corresponding thereto, respectively. Here, a first gap G1 between the dielectric layer 4 and the second and third source electrode portions 62 and 63 may change into a second gap G2 less than that in the initial state.

When a voltage is applied again to the gate electrode 3 and if the voltage is equal to the second pull-in voltage of the second source electrode portion 62 and less than a third pull-in voltage of the third source electrode portion 63, the second elastic portion 72 is deformed as illustrated in FIG. 4B and (c) of FIG. 5, and the second source electrode portion 62 may come into contact with the second drain electrode portion 52. Here, the third pull-in voltage has a value higher than that of the second pull-in voltage, and may be defined as a voltage which is applied to reduce contact resistance so that a magnitude of a contact force, by which the second source electrode portion 62 is brought into contact with the second drain electrode portion 52, further increases.

In particular, the second elastic portion 72 is deformed into a bent shape having an inclination downward from the horizontal direction, and thus, the second material M2 provided on the bottom surface of the second source electrode portion 62 may come into contact with the second drain electrode portion 52 made of the fourth material M4. Here, the second material M2 and the fourth material M4 are the same material and may include, for example, gold (Au) having hardness lower than that of each of the first material M1 and the third material M3. However, the scope of the present disclosure is not limited thereto. Also, according to another embodiment, a second material M2 and a fourth material M4, which have lower hardness than a first material M1 and a third material M3 but are made of different materials having different hardness, may be applied to the present disclosure in the same/similar manner.

In the present disclosure, the second elastic portion 72 may be provided in plurality. When the plurality of second elastic portions 72 are deformed together around the first source electrode portion 61, the second materials M2 provided on the bottom surfaces of the second source electrode portions 62 may come into contact with the second drain electrode portions 51 which are made of the fourth materials M4 corresponding thereto, respectively. Here, the two beams constituting the second elastic portions 72 may be equally deformed together on one side and the other side around the first source electrode portion 61. Here, the second gap G2 between the third source electrode portion 63 and the dielectric layer 4 may change into a third gap G3 less than that in FIG. 4A.

Subsequently, when a voltage is applied to the gate electrode 3 and if the voltage is equal to the third pull-in voltage of the third source electrode portion 63, the third elastic portion 73 is deformed as illustrated in FIG. 4C and (d) of FIG. 5, and the third source electrode portion 63 may come into contact with the dielectric layer 4.

In particular, the third elastic portion 73 is deformed having an inclination downward from the horizontal direction, and thus, the plurality of third source electrode portion 63 may come into contact with the dielectric layer 4.

When the third elastic portion 73 is deformed around the second source electrode portion 62, the gap G3 between the third source electrode portion 63 and the dielectric layer 4 becomes less than that in FIG. 4B, and thus, the gap therebetween disappears. Here, the three beams constituting the third elastic portions 73 may be equally deformed together around the second source electrode portion 62.

In states of FIG. 4C and (d) of FIG. 5, the third pull-in voltage higher than the second pull-in voltage is applied to the gate electrode 3, and the contact force significantly increases while the contact resistance significantly decreases. Accordingly, a high-current signal and a high-voltage signal may be switched.

For reference, an inversely proportional relationship between the contact resistance and the contact force may be referred to by the following equation.

$$\boxed{R_c} = \frac{\sqrt{\pi\xi}}{2}\rho\sqrt{\frac{H}{\boxed{F_c}}}$$

$R_c$ : Contact Resistance
$F_c$ : Contact Force
$\rho$ : Resistivity
$H$ : Hardness Here, the two beams are used in the second elastic portions 72, but in the third elastic portions 73, the three beams may be used to contribute to further maximizing the contact force. In more detail, the source plate 6 is moved downward due to the electrostatic force generated between the gate electrode 3 and the source electrode 60, and then, the contact force is determined by a restoring force of the elastic part 70. The three-beam structure has a greater restoring force than the two-beam structure, and thus, when the three-beam structure is used, the contact force may be maximized.

In summary, according to the present disclosure, the platinum-platinum contact may be established first to improve the reliability of the electrostatic drive switch through the high-voltage switching as illustrated in (b) of FIG. 5, and then, the gold-gold contact may be established later to reduce the contact resistance and further improve the contact force as illustrated in (c) of FIG. 5.

In more detail, the platinum contact may be established first to withstand the high voltage present between the source electrode 60 and the drain electrode 3, and after the platinum contact is made, the source plate 6 is allowed to further descend to establish gold contact. Here, the gold has relatively low resistance, which has a role in reducing the joule's heat due to the relatively high resistance of platinum, and the significantly low resistance may be achieved, thereby maximizing the contact force.

Also, according to the present disclosure, in a state in which the gold-gold contact has been established by the second elastic portion 72 as illustrated in (c) of FIG. 5, the voltage is additionally applied to further improve the contact force of gold-gold by the third elastic portion 73. Thus, the contact force generated at the contact point may be maximized. That is, since the contact force present in the contact material is inversely proportional to the contact resistance, the low contact resistance achieved by the high contact force may allow the high-current signal and high-voltage signal to be switched.

In a state in which the contact force is maximized as illustrated in (d) of FIG. 5, when a magnitude of the voltage applied to the gate electrode 3 is reduced, the second material M2 on the second source electrode portion 62 is separated first from the second drain electrode portion 52 made of the fourth material M4 as illustrated in (e) of FIG. 5, and the state thereof is changed into the state of second gap G2. When the voltage is turned off again, the first material M1 on the first source electrode portion 61 is also separated from the first drain electrode portion 51 made of the third material M3 as illustrated in (f) of FIG. 5, and the state thereof may return to the state of first gap G1.

That is, when the electrodes come into contact with each other, the contact between platinum and platinum having high hardness is made first, and the contact between gold and gold having low hardness is made later. However, when the electrodes are separated from each other, the separation between gold and gold, of which the contact has been made later, is made first, and the separation between platinum and platinum is made later. With the above configuration, the contact force may be maximized. That is, the third elastic portions 73 constituted by the three beams and having the greater restoring force are used first, and thus, the contact force may be further improved at the contact point.

Figure 6:
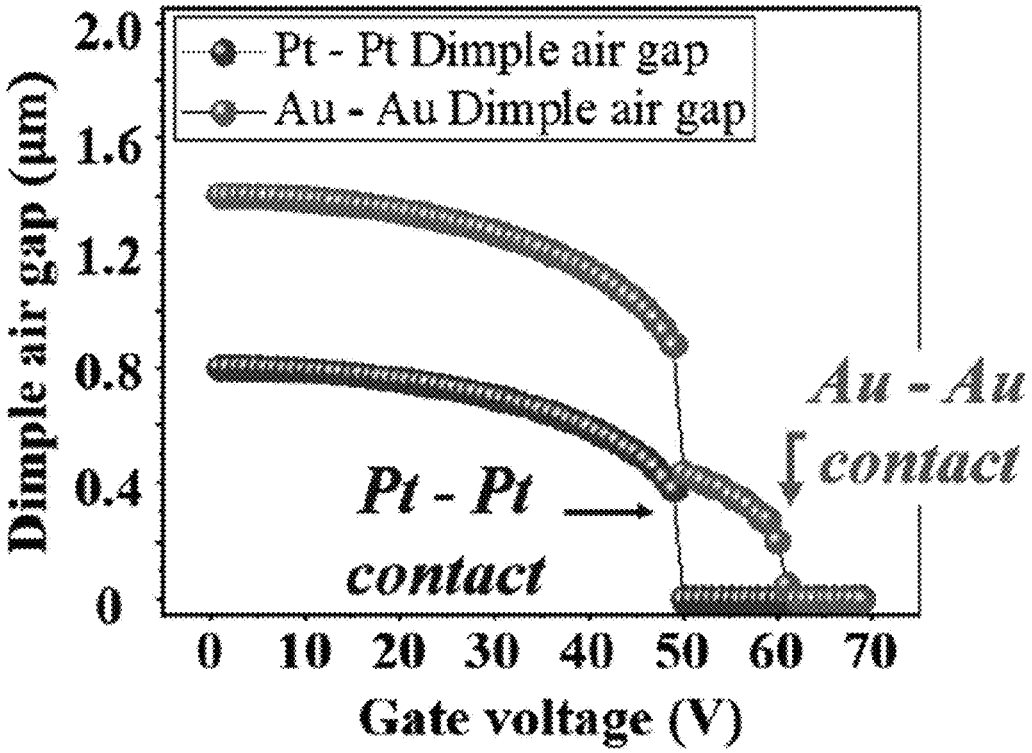
FIG. 6 is a view which is referred to show how an air gap changes as a voltage applied to a gate electrode increases in the present disclosure.

FIG. 6 is a view which is referred to show how an air gap changes as a voltage applied to the gate electrode 3 increases in the present disclosure.

As illustrated in FIG. 6, it may be found that, as the source plate 6 moves downward, an air gap between platinum and platinum and an air gap between gold and gold gradually decrease. For example, when the voltage reaches about 50 V, the contact between platinum and platinum may be made by a first pull-in phenomenon. Subsequently, when the voltage reaches about 61 V, the contact between gold and gold may be made by a second pull-in phenomenon.

According to the simulation results of FIG. 6, it may be found that voltage switching between the voltage of about 50 V and the voltage of about 61 V is sequentially performed.

Figure 7:
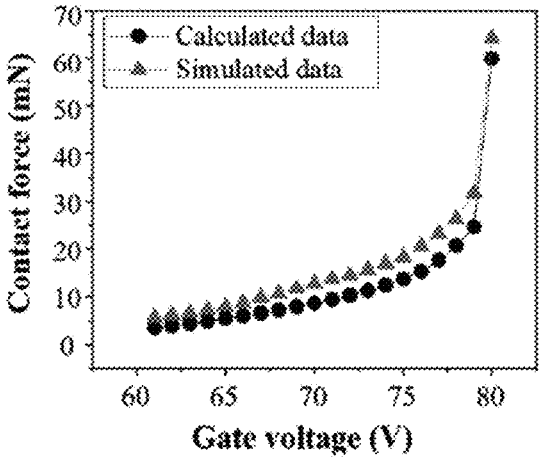
FIG. 7 is a graph showing that a contact force is maximized by a third pull-in phenomenon in the present disclosure.
Figure 7:
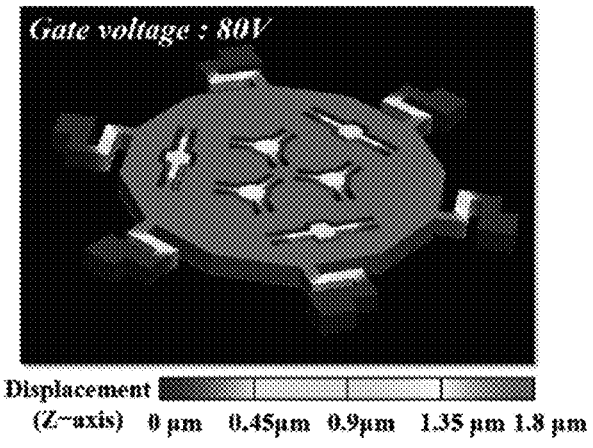

FIG. 7 is a graph showing that a contact force is maximized by a third pull-in phenomenon in the present disclosure.

According to FIG. 7, it is illustrated that, after the contact between gold and gold is made, the source plate 6 may be moved further downward by a third pull-in phenomenon. Accordingly, it may be found that the contact resistance significantly decreases, and the contact force significantly increases.

That is, during a process of increasing a magnitude of voltage so that a voltage of about 80 V is applied after a voltage of about 61 V is applied, the contact force between gold and gold gradually increases and is then maximized by the third pull-in phenomenon at a moment the voltage of about 80 V is applied. As a result, the entire third source electrode portion 63 may come into contact with the dielectric layer 4.

Figure 8:
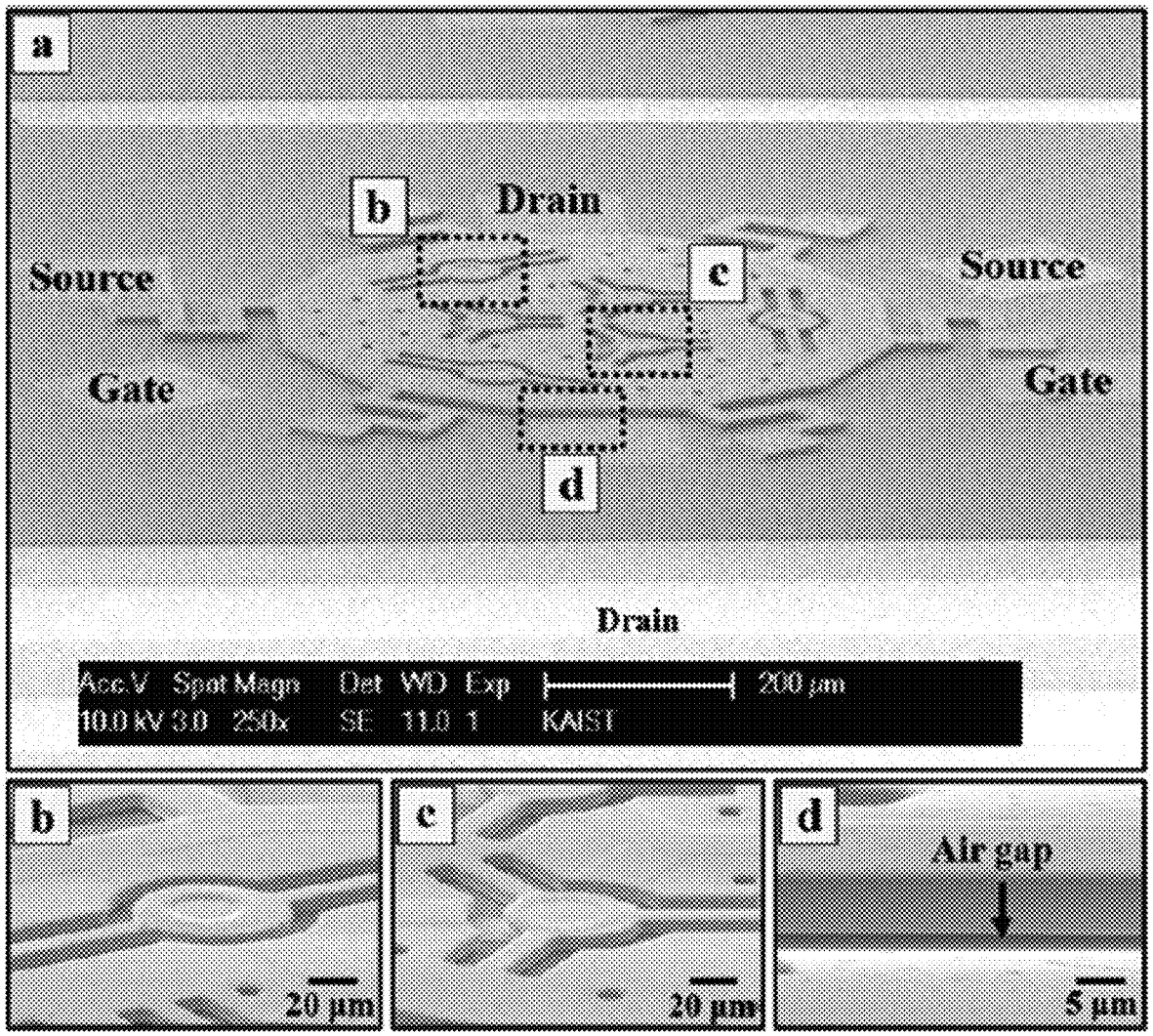
FIG. 8 shows a scanning electron microscope (SEM) image of an electrostatic drive switch of the present disclosure.

FIG. 8 shows a scanning electron microscope (SEM) image of an electrostatic drive switch of the present disclosure.

In (a) of FIG. 8, the entire structure of the source plate 6 embodied according to the present disclosure is shown. As illustrated in (b) and (c) of FIG. 8, it may be found that the second elastic portions 72 and the third elastic portions 73 are successfully manufactured. Also, as illustrated in (d) of FIG. 8, it may be found that the air gap is also successfully provided.

Figure 9:
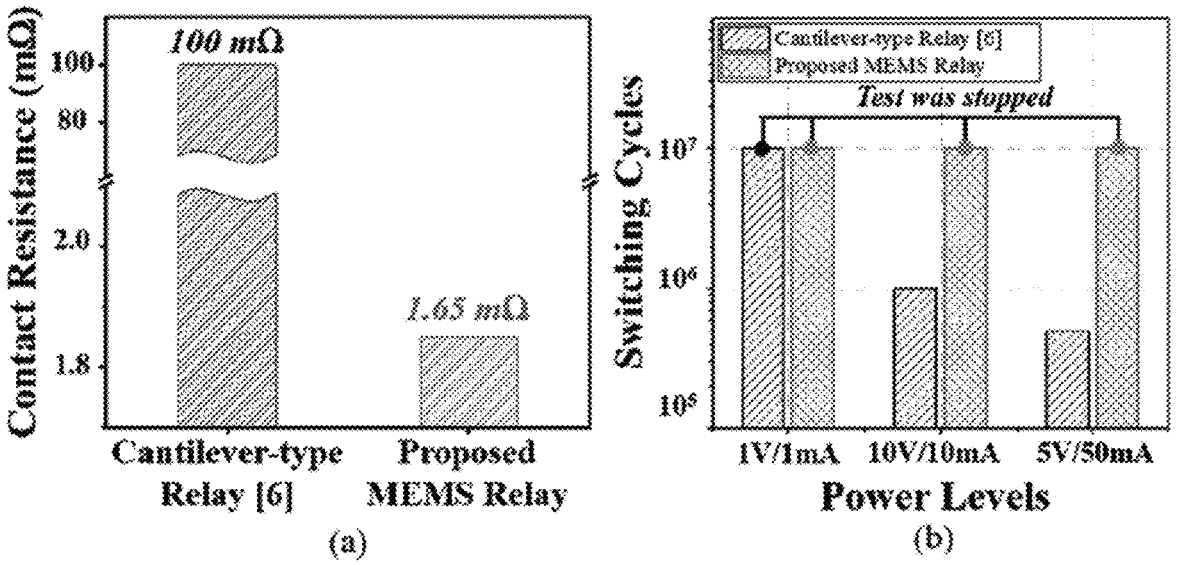
FIG. 9 is a view referred to show performance of an electrostatic drive switch embodied according to the present disclosure.

FIG. 9 is a view referred to show performance of an electrostatic drive switch embodied according to the present disclosure.

As illustrated in FIG. 9, it may be found that the electrostatic drive switch according to the present disclosure has the significantly low contact resistance, compared to a general electrostatic drive switch according to the related art, and thus, the high-voltage switching and the high-current switching may be possible through the high contact force.

Figure 10:
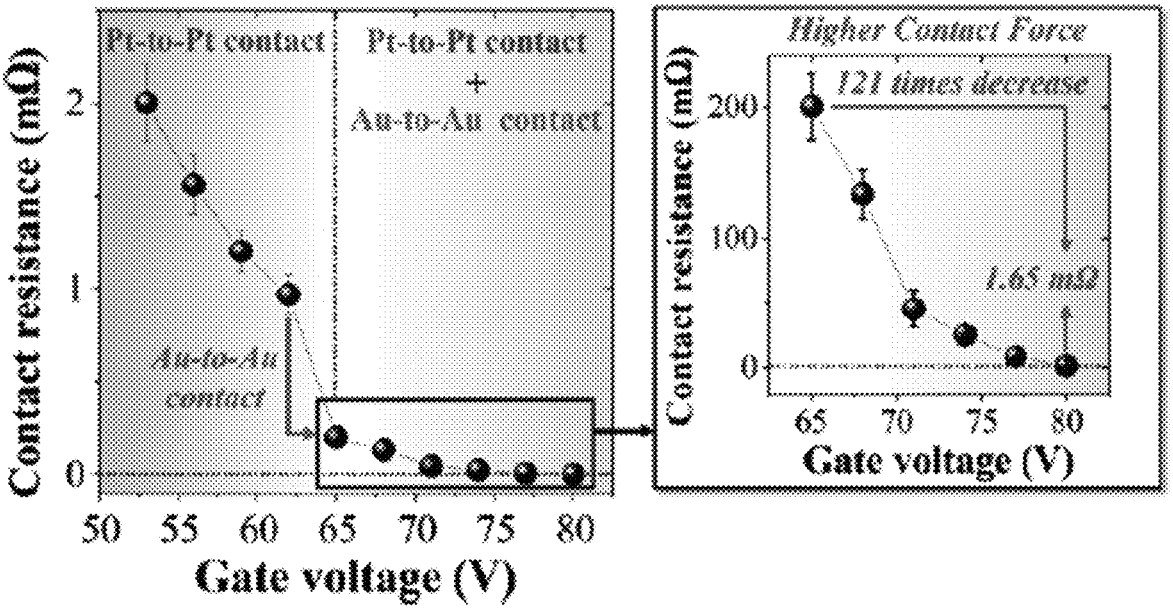
FIG. 10 is a graph showing a change in contact resistance, depending on a voltage applied according to the present disclosure, and a consequent relationship with a contact force.

FIG. 10 is a graph showing a change in contact resistance, depending on a voltage applied according to the present disclosure, and a consequent relationship with a contact force.

As illustrated in FIG. 10, when a voltage of about 53 V is applied to the gate electrode 3, the platinum-platinum contact is made. Here, a relatively high contact resistance of about 2Ω is generated due to the relatively high hardness of the platinum material. Subsequently, when a voltage of about 65 V is applied to the gate electrode 3, the gold-gold contact is made, and accordingly, the contact resistance is reduced from about 0.96Ω to about 200 mΩ. Also, when a voltage of about 80 V is applied to the gate electrode 3, the contact resistance is reduced again to about 1.65 mΩ. Consequently, it may be found that the contact resistance is significantly reduced.

Figure 11:
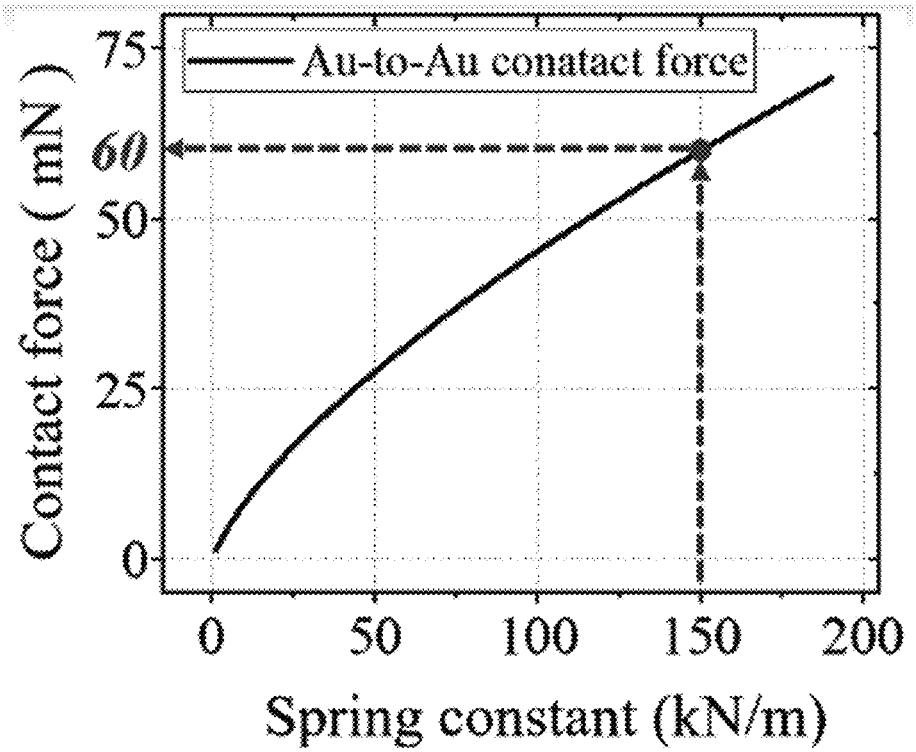
FIG. 11 is a graph showing a relationship between a spring constant of a third elastic portion and a contact force according to the present disclosure.

FIG. 11 is a graph showing a relationship between a spring constant of the third elastic portion 73 and a contact force according to the present disclosure.

As illustrated in FIG. 11, it may be found that, when the spring constant is about 150 kN/m or more, the air gap between gold and gold becomes about 0.4 or less. That is, the contact force may be maximized up to about 60 mN by setting the spring constant to about 150 kN/m according to the embodiment.

Figure 12:
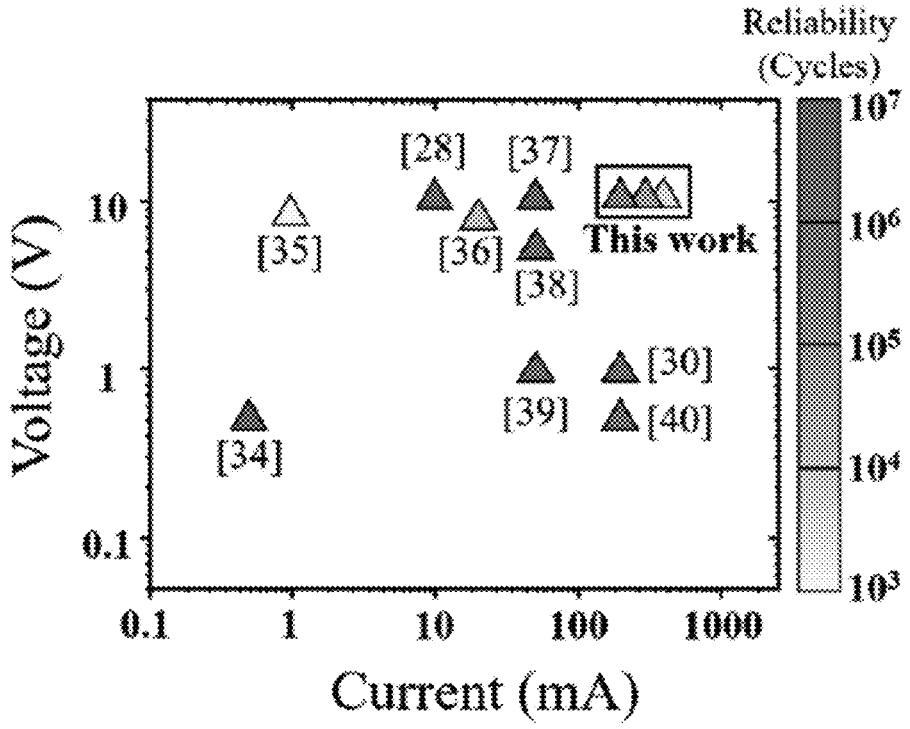
FIG. 12 is a graph showing a result of high reliability achieved as an electrostatic drive switch according to the present disclosure is driven.

FIG. 12 is a graph showing a result of high reliability achieved as an electrostatic drive switch according to the present disclosure is driven.

As illustrated in FIG. 12, in the present disclosure compared to a general electrostatic drive switch according to the related art, it may be found that the high reliability is achieved in the high voltage-high current switching condition.

According to the present disclosure, the platinum-platinum contact is established first to improve the reliability with respect to the high-voltage switching, and the gold-gold contact is established later to improve the reliability with respect to the high-current switching. Thus, the contact resistance may be reduced, and the contact force may be further improved.

Also, according to the present disclosure, the platinum contact may be established first to withstand high voltage present between the source electrode and the drain electrode, and after the platinum contact is made, the source plate is allowed to further descend to establish the gold contact. Here, the gold has relatively low specific resistance, which has a role in reducing the joule's heat due to the relatively high resistance of platinum, and the significantly low resistance may be achieved by maximizing the contact force.

Also, according to the present disclosure, in a state in which the gold-gold contact has been established by the second elastic portion, the voltage is additionally applied to further improve the contact force of gold-gold by the third elastic portion. Thus, the contact force that generates at the contact point may be maximized.

That is, since the contact force present in the contact material is inversely proportional to the contact resistance, the low contact resistance achieved by the high contact force may allow the high-current signal to be switched.

The features, structures, and effects, and the like described in the embodiments are included in one embodiment of the present disclosure and are not necessarily limited to one embodiment. Furthermore, the features, structures, effects, and the like exemplified in each embodiment can be combined or modified in other embodiments by those skilled in the art to which the embodiments belong. Therefore, contents related to the combination and modification should be construed to be included in the scope of the present disclosure.

Although embodiments of the present disclosure have been described above, these are just examples and do not limit the present disclosure. Further, the present disclosure may be modified and applied in various ways, without departing from the essential features of the embodiments, by those skilled in the art to which the present disclosure pertains. For example, the components described in detail in the embodiments of the present disclosure may be modified. Further, differences due to the modification and application should be construed as being included in the scope of the present disclosure as defined in the appended claims.

What is claimed is:

1. An electrostatic drive switch comprising:

a source plate to which a voltage for driving the electrostatic drive switch is applied; and a drain electrode spaced apart from the source plate, wherein the source plate comprises a source electrode and an elastic part connected to the source electrode, the elastic part comprising a first elastic portion disposed in an outer portion of the source plate and a second elastic portion separated from the first elastic portion, a first material and a second material having lower hardness than the first material are provided on the source electrode, and when the source electrode and the drain electrode are electrically connected to each other by the voltage, the second material is brought into contact with the drain electrode by the second elastic portion after the first material is brought into contact with the drain electrode by the first elastic portion.

2. The electrostatic drive switch of claim 1, wherein the source electrode comprises a first source electrode portion on which the first material is provided and a second source electrode portion on which the second material is provided, the second elastic portion is connected to the first source electrode portion, and the second material provided on the second source electrode portion is brought into contact with the drain electrode by the second elastic portion after the first material provided on the first source electrode portion is brought into contact with the drain electrode by the first elastic portion.

3. The electrostatic drive switch of claim 2, wherein the drain electrode comprises a first drain electrode portion made of a third material and a second drain electrode portion made of a fourth material, wherein the second material provided on the second source electrode portion is brought into contact with the second drain electrode portion by the second elastic portion after the first material provided on the first source electrode portion is brought into contact with the first drain electrode portion by the first elastic portion.

4. The electrostatic drive switch of claim 3, wherein the third material is the same material as the first material, and the fourth material is the same material as the second material.

5. The electrostatic drive switch of claim 2, further comprising an dielectric layer, wherein the source electrode further comprises a third source electrode portion in which neither the first material nor the second material is provided, and the third source electrode portion is brought into contact with the dielectric layer by a third elastic portion connected to the second source electrode portion.

6. The electrostatic drive switch of claim 5, wherein the third elastic portion comprises a beam that has a spring constant greater than that of the second elastic portion.

7. The electrostatic drive switch of claim 5, wherein at least one of an area of the first source electrode portion and an area of the second source electrode portion is less than an area of the third source electrode portion.

8. The electrostatic drive switch of claim 3, wherein an area of the first material provided on the first source electrode portion is less than an area of the first drain electrode portion made of the third material, and an area of the second material provided on the second source electrode portion is less than an area of the second drain electrode portion made of the fourth material.

9. The electrostatic drive switch of claim 2, wherein a height of the first source electrode portion is greater than a height of the second source electrode portion.

10. The electrostatic drive switch of claim 2, wherein each of the first source electrode portion, the second source electrode portion, the first elastic portion, and the second elastic portion is provided in plurality.

11. The electrostatic drive switch of claim 10, wherein both a center of the plurality of first source electrode portions and a center of the plurality of second source electrode portions is the same as a center of the source plate.

12. The electrostatic drive switch of claim 1, wherein when the source electrode and the drain electrode are separated from each other, the first material is separated from the drain electrode by the elastic part after the second material is separated from the drain electrode by the elastic part.

* * * * *